US010968501B2

(12) United States Patent
Eberl et al.

(10) Patent No.: US 10,968,501 B2
(45) Date of Patent: Apr. 6, 2021

(54) TRANSFORMATION PROCESS OF AL—CU—LI ALLOY SHEETS

(71) Applicant: CONSTELLIUM FRANCE, Paris (FR)

(72) Inventors: Frank Eberl, Issoire (FR); Bernard Bes, Seyssins (FR)

(73) Assignee: CONSTELLIUM FRANCE, Paris (FR)

( * ) Notice: Subject to any disclaimer, the term of this patent is extended or adjusted under 35 U.S.C. 154(b) by 437 days.

(21) Appl. No.: 13/651,002

(22) Filed: Oct. 12, 2012

(65) Prior Publication Data

US 2013/0092294 A1 Apr. 18, 2013

Related U.S. Application Data

(60) Provisional application No. 61/547,289, filed on Oct. 14, 2011.

(30) Foreign Application Priority Data

Oct. 14, 2011 (FR) ..... 1103155

(51) Int. Cl.
*C22C 21/12* (2006.01)
*C22C 21/16* (2006.01)
*C22F 1/057* (2006.01)

(52) U.S. Cl.
CPC ..... *C22C 21/12* (2013.01); *C22C 21/16* (2013.01); *C22F 1/057* (2013.01)

(58) Field of Classification Search
CPC ..... C22C 1/26
(Continued)

(56) References Cited

U.S. PATENT DOCUMENTS 2,083,576 A * 6/1937 Nock, Jr. ..... C22C 21/12 148/695
3,706,606 A * 12/1972 Di Russo ..... C22F 1/057 148/697

(Continued)

FOREIGN PATENT DOCUMENTS

CN 101967588 A * 2/2011 ..... C22C 21/12
EP 1045043 B1 5/2005

(Continued)

OTHER PUBLICATIONS

J. Chen, Y. Madi, T. F. Morgeneyer, J. Besson. "Plastic flow and ductile rupture of a 2198 Al—Cu—Li aluminum alloy." Computational Materials Science 50 (2011) 1365-1371.*
CN101967588 machine translation.*
WO20100149873 machine translation.*
No. 2198 Registered Composition. International Alloy Designations and Chemical Composition Limits for Wrought Aluminum and Wrought Aluminum Alloys. The Aluminum Association. Feb. 2009. p. 4.*

(Continued)

*Primary Examiner* — Paul A Wartalowicz
*Assistant Examiner* — Stephani Hill
(74) *Attorney, Agent, or Firm* — McBee Moore & Vanik IP, LLC

(57) ABSTRACT

The invention concerns a process to manufacture a flat-rolled product, notably for the aeronautic industry containing aluminum alloy, in which, notably a flattening and/or stretching is performed with a cumulated deformation of at least 0.5% and less than 3% and a short heat-treatment is performed in which the sheet reaches a temperature between 130° C. and 170° C. for a period of 0.1 to 13 hours. The invention notably makes it possible to simplify the forming process of fuselage skins and to improve the balance between static mechanical strength properties and damage tolerance properties.

14 Claims, 2 Drawing Sheets

(58) Field of Classification Search
USPC ..... 420/528, 529, 533, 534, 535
See application file for complete search history.

(56) References Cited

U.S. PATENT DOCUMENTS

| | | | | | |
|---|---|---|---|---|---|
| 4,806,174 | A * | 2/1989 | Cho | C22F 1/04 | 148/693 |
| 4,812,178 | A * | 3/1989 | Dubost | C22F 1/04 | 148/415 |
| 5,032,359 | A | 7/1991 | Pickens et al. | | |
| 5,076,859 | A * | 12/1991 | Rioja | C22C 21/00 | 148/695 |
| 5,234,662 | A * | 8/1993 | Balmuth | C22C 21/12 | 148/416 |
| 5,259,897 | A * | 11/1993 | Pickens | C22C 21/12 | 148/417 |
| 5,455,003 | A | 10/1995 | Pickens et al. | | |
| 7,229,509 | B2 | 6/2007 | Cho | | |
| 7,438,772 | B2 | 10/2008 | Rioja et al. | | |
| 2003/0140990 | A1 | 7/2003 | Ribes et al. | | |
| 2004/0071586 | A1 | 4/2004 | Rioja et al. | | |
| 2007/0181229 | A1* | 8/2007 | Bes | C22C 21/16 | 148/552 |
| 2008/0289728 | A1* | 11/2008 | Bes | 148/552 | |
| 2009/0142222 | A1 | 6/2009 | Colvin et al. | | |
| 2010/0288400 | A1* | 11/2010 | Bordesoules | B23K 20/122 | 148/535 |
| 2012/0055590 | A1* | 3/2012 | Kamat | C22C 21/10 | 148/551 |

FOREIGN PATENT DOCUMENTS

| | | | | |
|---|---|---|---|---|
| FR | WO20100149873 | A1 * | 12/2010 | C22C 21/00 |
| WO | 2006131627 | A1 | 12/2006 | |
| WO | 2007080267 | A1 | 7/2007 | |

OTHER PUBLICATIONS

Pfost, et al. "The effect of solution treatment and rolling mode on the mechanical properties of 2090 Al—Li alloy." Journal of Materials Processing Technology 56 (1996) 542-551.*

B. Decreus. A. Deschamps, P. Donnadieu. "Understanding the mechanical properties of 2198 Al—Li—Cu alloy in relation with the intra-granular and inter-granular precipitate microstructure." 15th International Conference on the Strength of Materials (ICSMA-15) Journal of Physics: Conference Series 240 (2010) 012096.*

C. Giummarra, B. Thomas, R. J. Rioja. "New aluminum lithium alloys for aerospace applications." Proceedings of the Light Metals Technology Conference 2007.*

No. 2199. International Alloy Designations and Chemical Composition Limits for Wrought Aluminum and Wrought Aluminum Alloys. The Aluminum Associated. Revised Feb. 2009. p. 4.*

V. T. Saccon. "Characterisation of AA2198 T851 and AA2139 T3 Aluminum Alloy Joined by Friction Stir Welding." Jun. 2008. Helmholtz Gemeinschaft. Slide 2—Material.*

International Alloy Designations and Chemical Composition Limits for Wrought Aluminum and Wrought Aluminum Alloys. Jan. 2015. (Year: 2015).*

Tempus G, "New Aluminium Alloys and Fuselage Structures in Aircraft Design", Internet Citations, May 18, 2001, pp. 1-24, XP002664640, URL:http://www.mat.ethz.ch/news_events/archive/materialsday/matday01/pdf/TempusMD.pdf.

Zhang Siqi et al., "Mechanical Properties and Microstructures of Al—Mg—Li—Zr alloys-containing silver", Transaction of Nonferrouse Metals Dociety of China, CN, vol. 4, No. 4, Dec. 1, 1994, XP002664652, ISSN: 1003-6326.

French Search Report from FR1103155 dated May 9, 2012.

* cited by examiner

TRANSFORMATION PROCESS OF AL—CU—LI ALLOY SHEETS

CROSS REFERENCE TO RELATED APPLICATIONS

This application claims the priority to French Application No. 1103155, filed Oct. 14, 2011, and U.S. Provisional Application No. 61/547,289, filed Oct. 14, 2011, the contents of both of which are incorporated herein by reference in their entireties.

BACKGROUND OF THE INVENTION

Field of the Invention

The invention relates to aluminum-copper-lithium alloy products, and more particularly to such products, their manufacturing processes and use, designed in particular for aeronautical and aerospace engineering.

Description of Related Art

Flat-rolled products made of aluminum alloy are developed to produce parts of high strength designed for the aircraft and aerospace industry in particular.

Aluminum alloys containing lithium are of great interest in this respect because lithium can reduce the density of aluminum by 3% and increase the modulus of elasticity by 6% for each percent of lithium weight added. For these alloys to be selected for aircraft, their performance as compared to the other usual properties must attain that of alloys in regular use, in particular in terms of the balance between static mechanical strength properties (yield stress, ultimate tensile strength) and damage tolerance properties (toughness, resistance to fatigue crack propagation), these properties being in general in opposition to each other. The improvement in the balance between the mechanical strength and damage tolerance is constantly sought.

Another important property of thin Al—Cu—Li alloy sheets, notably those having a thickness between 0.5 mm and 12 mm, is the ability to be formed. These sheets are notably used to make aircraft fuselage elements or rocket elements that have a complex general 3-dimensional shape. In order to reduce the fabrication cost, aircraft manufacturers seek to minimize the number of sheet forming steps, and to use sheets that can be manufactured inexpensively by means of short transformation processes, i.e. comprising as few individual steps as possible.

For the fabrication of fuselage panels, there are currently several possible processing steps, which notably depend on the deformation required during the forming process. For small deformations during forming, typically less than 4%, it is possible to supply sheets in an as-quenched and naturally-aged temper (slightly tempered "T3" or "T4"), and to form sheets in this state.

However, in the majority of cases, the deformation sought is at least 5% or 6% locally. A current practice of aircraft manufacturers generally consists of procuring hot or cold-rolled sheets depending on the required thickness, as manufactured ("F" temper as per standard EN 515), naturally-aged temper ("T3" or "T4" temper), annealed ("O" temper), subjecting them to a solution heat-treatment followed by quenching, and then forming in an as-quenched state ("W" temper), before finally submitting them to natural or artificial aging, so as to obtain the required mechanical properties. Generally speaking, after solution heat-treatment and quenching, the sheets are in a state characterized by good formability, although this state is unstable ("W" temper), and forming must take place in an as-quenched condition, i.e. inside a brief delay after the quench, from roughly ten minutes to a few hours. If this is not possible for production management reasons, the sheet must be stored in a cold room at a sufficiently low temperature and for a sufficiently short duration to avoid natural maturation. In certain cases, it is noted that for excessively short durations after solution heat-treatment, Lüders lines appear after forming, which requires an additional requirement with a minimum waiting period. For voluminous and highly formed parts, this solution heat-treatment requires large-scale furnaces, which makes the operation cumbersome, including in relation to the same operation performed on flat sheet. The possible need for a cold room adds to the costs and drawbacks of the prior art. In addition, the sheet may be deformed after quenching and create problems associated with this deformation, for example, when positioning it in the jaws of the stretch-forming tool. For highly formed parts, this operation may be repeated if necessary, if the material does not have sufficient formability, in its current metallurgical state, enabling it to attain the desired shape in a single operation.

In another current practice, starting from an O-temper sheet, or even T3, T4 or F-temper sheet, an initial forming operation is performed from this temper, and a second forming operation is performed after the solution heat-treatment and quench. This variant is particularly used when the desired shape cannot be performed in a single operation starting from a W-temper, although it may be performed in two passes from O-temper. Furthermore, as O-temper sheets are more stable over time, they are easier to transform. However, the manufacture of O-temper sheets involves a final annealing of the as-rolled sheet, and thus generally an additional manufacturing process, and also solution heat-treatment and quenching on the product formed which is contrary to the aim of simplification covered by the present invention.

Forming complex structural elements in a T8 temper is limited to mild forming because elongation and the ratio $R_m/R_{p0.2}$ are too low in this temper.

Note that the optimal properties, in terms of the compromise of properties, must be obtained once the part is formed, particularly as a fuselage element, since it is the shaped part that must particularly have good performance characteristics in terms of damage tolerance in order to avoid excessively frequent repair of the fuselage elements. It is generally accepted that complex deformations after solution heat-treatment and quenching lead to an increase in mechanical strength but with a sharp deterioration in toughness.

U.S. Pat. No. 5,032,359 describes a vast family of aluminum-copper-lithium alloys in which the addition of magnesium and silver, in particular between 0.3 and 0.5 percent by weight, makes it possible to increase the mechanical strength.

U.S. Pat. No. 5,455,003 describes a process for manufacturing Al—Cu—Li alloys that have improved mechanical strength and fracture toughness at cryogenic temperature, in particular owing to appropriate strain hardening and aging. This patent particularly recommends the composition, expressed as a percentage by weight, Cu=3.0-4.5, Li=0.7-1.1. Ag=0-0.6, Mg=0.3-0.6 and Zn=0-0.75.

U.S. Pat. No. 7,438,772 describes alloys including, expressed as a percentage by weight, Cu: 3-5, Mg: 0.5-2, Li: 0.01-0.9 and discourages the use of higher lithium content because of a reduction in the balance between fracture toughness and mechanical strength.

U.S. Pat. No. 7,229,509 describes an alloy including (% by weight): (2.5-5.5) Cu, (0.1-2.5) Li, (0.2-1.0) Mg, (0.2-

0.8) Ag, (0.2-0.8) Mn, 0.4 max Zr or other grain-refining agents such as Cr, Ti, Hf, Sc, and V.

US patent application 2009/142222 A1 describes alloys including (as a percentage by weight), 3.4% to 4.2% Cu, 0.9% to 1.4% Li, 0.3% to 0.7% Ag, 0.1% to 0.6%, Mg, 0.2% to 0.8% Zn, 0.1% to 0.6% Mn and 0.01% to 0.6% of at least one element for controlling the granular structure. This application also describes a process for manufacturing extruded products.

Patent EP 1,966,402 describes an alloy that does not contain zirconium designed for fuselage sheets with a primarily recrystallized structure including (as a % by weight) (2.1-2.8) Cu, (1.1-1.7) Li, (0.2-0.6) Mg, (0.1-0.8) Ag, and (0.2-0.6) Mn. The products obtained in a T8 temper are not suitable for forming, inter alia because the ratio $R_m/R_{p0.2}$ is less than 1.2 in the directions L and LT.

Patent EP 1,891,247 describes an alloy designed for fuselage sheets including (as a % by weight) (3.0-3.4) Cu, (0.8-1.2) Li, (0.2-0.6) Mg, (0.2-0.5) Ag and at least one element out of Zr, Mn, Cr, Sc, Hf and Ti, in which the Cu and Li contents meet the condition Cu+5/3 Li<5.2. The products obtained in a T8 temper are not suitable for forming, inter alia because the ratio $R_m/R_{p0.2}$ is less than 1.2 in the directions L and LT. It was further found that the total energy at break measured by Kahn test which is connected to toughness decreases with deformation and with a more brutal decrease for 6% strain, which poses the problem of obtaining high toughness regardless of the rate of local deformation during forming.

The patent EP 1,045,043 describes the process for manufacturing parts formed by AA2024 type alloy, and notably highly deformed parts, through the association of an optimized chemical composition and special manufacturing processes, enabling the solution heat-treatment on a formed sheet as much as possible.

In the article Al-(4.5-6.3)Cu-1.3Li-0.4Ag-0.4Mg-0.14Zr Alloy Weldalite 049 from Pickens, J. R.; Heubaum, F. H.; Langan, T. J.; Kramer, L. S. published in Aluminum-Lithium Alloys. Vol. III; Williamsburg, Va.; USA; 27-31 Mar. 1989. (Mar. 27, 1989), various heat treatments are described for these alloys with high copper content.

There exists a need for flat-rolled products made of aluminum-copper-lithium alloy presenting improved properties as compared with those of known products, particularly in terms of the balance between static mechanical strength properties and damage tolerance properties even after a high level of strain during forming, while being of low density.

There is also a need for a simplified manufacturing process for forming these products to economically obtain fuselage elements, while obtaining satisfactory mechanical characteristics.

SUMMARY

A first subject of the present invention was the provision of a manufacturing process for a flat-rolled product containing aluminum alloy notably for the aeronautic industry in which, preferably in succession, a) a molten metal bath containing aluminum is produced comprising 2.1% to 3.9% Cu by weight, 0.7% to 2.0% Li by weight, 0.1% to 1.0% Mg by weight, 0% to 0.6% Ag by weight, 0% to 1% Zn by weight, at the most 0.20% Fe+Si by weight, at least one element chosen from Zr, Mn, Cr, Sc, Hf and Ti, the quantity of said element, if it is chosen, being from 0.05% to 0.18% by weight for Zr, 0.1% to 0.6% by weight for Mn, 0.05% to 0.3% by weight for Cr, 0.02% to 0.2% by weight for Sc, 0.05% to 0.5% by weight for Hf and 0.01% to 0.15% by weight for Ti, the other elements at most 0.05% by weight each and 0.15% by weight in total, the rest aluminum;

b) a rolling ingot is cast from said molten metal bath;

c) optionally, said rolling ingot is homogenized;

d) said rolling ingot is hot rolled, and optionally cold rolled, into a sheet;

e) said sheet undergoes solution heat-treatment and quenching;

f) said sheet undergoes flattening and/or stretching with a cumulated deformation of at least 0.5% and less than 3%;

g) short heat-treatment is performed in which said sheet reaches a temperature ranging between 130° C. and 170° C. and preferably between 150° C. and 160° C. for 0.1 to 13 hours and preferably from 1 to 5 hours.

A second subject of the invention was the provision of a flat-rolled product obtainable by a process according to the invention, having between 0 and 50 days after short heat-treatment, a combination of at least one property chosen among $R_{p0.2}$(L) of at least 220 Mpa and preferably of at least 250 Mpa, $R_{p0.2}$(LT) of at least 200 Mpa and preferably at least 230 Mpa, $R_m$(L) of at least 340 Mpa and preferably at least 380 Mpa, $R_m$(LT) of at least 320 Mpa and preferably at least 360 Mpa with a property chosen among A % (L) at least 14% and preferably at least 15%, A % (LT) at least 24% and preferably at least 26%, $R_m/R_{p0.2}$(L) at least 1.40 and preferably at least 1.45, $R_m/R_{p0.2}$(LT) at least 1.45 and preferably at least 1.50.

Another subject of the invention is a product obtainable by a process according to the invention, having a tensile yield strength $R_{p0.2}$(L) at least essentially equal to and a toughness $K_R$ greater, preferably by at least 5%, than those obtained by a similar process not comprising a short heat-treatment.

Yet another subject of the invention was directed to the use of a product obtainable by the process according to the invention for the manufacture of an aircraft fuselage skin.

DETAILED DESCRIPTION OF A PREFERRED EMBODIMENT

Figure 1:
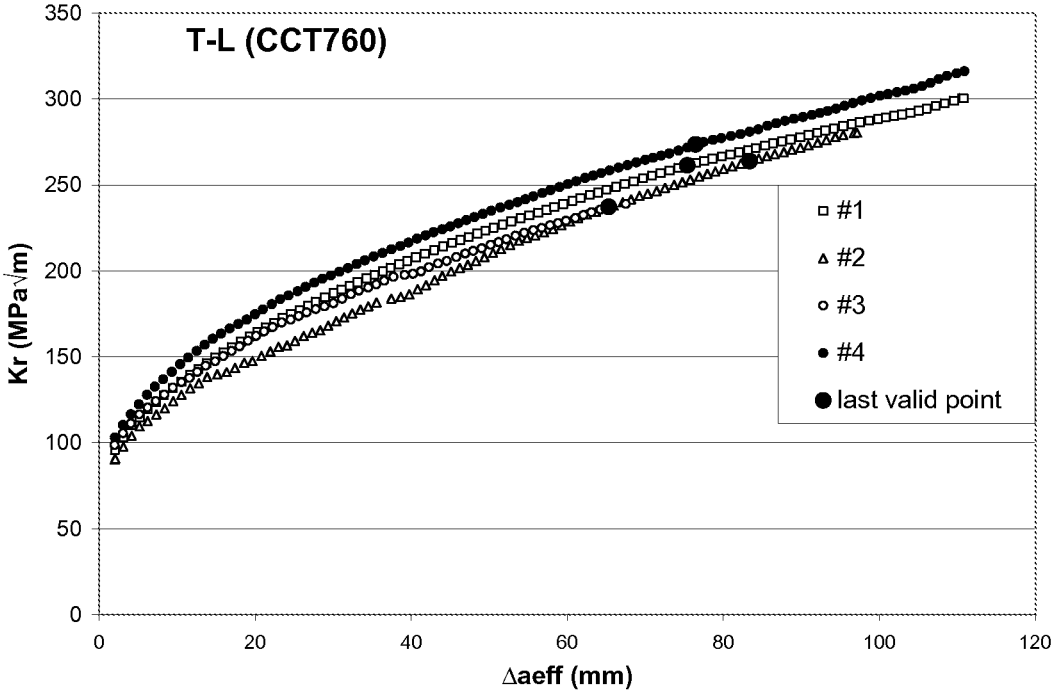
FIG. 1: R-curves obtained in the T-L direction for the samples of example 1

Unless otherwise stated, all the indications concerning the chemical composition of the alloys are expressed as a percentage by weight based on the total weight of the alloy. The expression 1.4 Cu means that the copper content expressed as a percentage by weight is multiplied by 1.4. Alloys are designated in conformity with the rules of The Aluminium Association, known to those skilled in the art. The definitions of the metallurgical tempers are indicated in European standard EN 515.

The static mechanical properties under stretching, in other words the ultimate tensile strength $R_m$, the conventional yield strength at 0.2% offset ($Rp_{0.2}$) and elongation at break A %, are determined by a tensile test according to standard EN ISO 6892-1, and sampling and test direction being defined by standard EN 485-1.

Plane stress fracture toughness was determined from a curve of the effective stress intensity factor as a function of the crack extension, known as R-curve, is determined according to standard ASTM E 561. The critical stress intensity factor $K_C$, in other words the intensity factor which makes the crack unstable, is calculated from R-curve. The stress intensity factor $K_{CO}$ is also calculated by allotting the initial crack length at the beginning of the monotonic load, at critical load. These two values are calculated for a test-specimen of the required shape. $K_{app}$ represents factor $K_{CO}$ corresponding to the test specimen that was used to carry out the test of R-curve. $K_{eff}$ represents factor $K_C$ corresponding to the test specimen which was used to carry out the R-curve test. $\Delta a_{eff(max}$ represents the crack extension of the last valid point of the R-curve "Structural element" of a mechanical construction here refers to a mechanical part for which the static and/or dynamic mechanical properties are particularly important for the performance of the structure, and for which a structural analysis is usually prescribed or performed. These are typically elements for which its failure is likely to endanger the safety of said construction, its users or others. For an aircraft, these structural elements include the parts which make up the fuselage (such as the fuselage skin, stringers, bulkheads, and circumferential frames), the wings (such as the top or bottom wing skin, stringers or stiffeners, ribs and spars) and the tail unit, made up of horizontal and vertical stabilizers, as well as floor beams, seat tracks and doors.

According to the invention, after rolling into sheet form, solution heat-treatment, quench and flattening and/or stretching, at least a short heat-treatment is performed with a duration and temperature such that the sheet reaches a temperature between 130° C. and 170° C. and preferably between 150° C. and 160° C. for a period of 0.1 to 13 hours, preferably 0.5 to 9 hours and preferably still from 1 to 5 hours. Typically, following this short heat-treatment, the yield strength $R_{p0.2}$ decreases significantly, i.e. by at least 20 MPa or more, while the elongation A % increases, i.e. is multiplied by a factor of at least 1.1, or by even at least 1.2 or even 1.3 in relation to the temper obtained without short heat-treatment, typically T3 or T4. The short heat treatment is not an artificial aging for obtaining a T8 temper but a special heat treatment that provides a non-standardized temper particularly suitable for forming. In fact, a sheet in T8 temper has a yield strength greater than that of a T3 or T4 temper, whereas after the short heat treatment according to the invention the yield strength is on the contrary lower than that of a T3 or T4 temper. Advantageously, the short heat-treatment is carried out to obtain an equivalent time at 150° C. from 0.5 h to 6 h and preferably from 1 h to 4 h and preferentially from 1 h to 3 h, the equivalent time $t_i$, at 150° C. is defined by the formula:

$$t_i = \frac{\int \exp(-16400/T)dt}{\exp(-16400/T_{ref})}$$

where T (in Kelvin) is the instantaneous treatment temperature of the metal, which changes with time t (in hours), and $T_{ref}$ is the reference temperature set at 423 K. $t_i$ is expressed in hours. The constant Q/R=16,400 K is derived from the activation energy of the diffusion of Cu, for which the value Q=136,100 J/mol was used.

Surprisingly, the present inventors noted that the mechanical properties obtained following short heat-treatment are stable over time, which allows the sheets to be used in a temper obtained from short heat-treatment instead of a sheet with on O-temper or a W-temper for the forming process.

The present inventors were surprised to note that the short heat treatment not only simplified the manufacturing process of the products by doing away with the forming process on temper O or W, but in addition, the balance between mechanical resistance and damage tolerance is at least identical or even improved owing to the process of the invention, in an aged temper compared to a process not including short heat treatment. In particular for an additional cold working of at least 5% after the short heat treatment, the balance between static mechanical strength and toughness is improved relative to the prior art.

The advantage of the process according to the invention is obtained for products having a copper content between 2.1% and 3.9% by weight. In an advantageous embodiment of the invention, the copper content is at least 2.8% or 3% by weight. A maximum copper content of 3.5% or 3.7% by weight is preferred.

The lithium content lies between 0.7% or 0.8% and 2.0% by weight. Advantageously, the lithium content is at least 0.85% by weight. A maximum lithium content of 1.6% or even 1.2% by weight is preferred.

The magnesium content lies between 0.1% and 1.0% by weight. Preferably, the magnesium content is at least 0.2% or even 0.25% by weight. In one embodiment of the invention, the maximum magnesium content is 0.6% by weight.

The silver content lies between 0% and 0.6% by weight. In an advantageous embodiment of the invention, the silver content is between 0.1% and 0.5% by weight and preferably between 0.15% and 0.4% by weight. The addition of silver helps to improve the balance of the mechanical properties of the products obtained by the process according to the invention.

The zinc content lies between 0% and 1% by weight. Zinc is generally an undesirable impurity, in particular owing to its contribution to the density of the alloy. However, in certain cases, zinc can be used alone or in combination with silver. Preferably, the zinc content is lower than 0.40% by weight, preferably 0.2% by weight. In one embodiment of the invention, the zinc content is less than 0.04% by weight.

The alloy also contains at least one element which may contribute to the control of grain size chosen from Zr, Mn, Cr, Sc, Hf and Ti, the quantity of the element, if it is chosen, being from 0.05% to 0.18% by weight for Zr, 0.1% to 0.6% by weight for Mn, 0.05% to 0.3% by weight for Cr, 0.02% to 0.2% by weight for Sc, 0.05% to 0.5% by weight for Hf and 0.01% to 0.15% by weight for Ti. Preferably, it is chosen to add between 0.08% and 0.15% by weight of zirconium and between 0.01% and 0.10% by weight of titanium and to limit the Mn, Cr, Sc and Hf content to 0.05% by weight maximum, as these elements can have a detrimental effect, particularly on density and are added only to further help obtain a primarily non-recrystallized structure, if necessary.

In an advantageous embodiment of the invention, the zirconium content is at least 0.11% by weight.

In another advantageous embodiment of the invention, the manganese content is between 0.2% and 0.4% by weight and the zirconium content is less than 0.04% by weight.

The sum of the iron content and the silicon content is at the most 0.20% by weight. Preferably, the iron and silicon contents are each at the most 0.08% by weight. In an advantageous embodiment of the invention the iron and silicon contents are at the most 0.06% and 0.04% by weight respectively. A controlled and limited iron and silicon content helps to improve the balance between mechanical strength and damage tolerance.

The other elements have a content of at most 0.05% by weight each and 0.15% by weight in total, this concerns inevitable impurities, the remainder is aluminum.

The manufacturing process according to the invention includes the stages of preparing, casting, rolling, solution heat-treatment, quenching, flattening and/or stretching and short heat-treatment.

In the first stage, a molten metal bath is prepared in order to obtain an aluminum alloy composed according to the invention.

The molten metal bath is then cast in the form of a rolling ingot.

The rolling ingot can optionally be homogenized in order to reach a temperature ranging between 450° C. and 550° C. and preferably between 480° C. and 530° C. for a length of time ranging between 5 hours and 60 hours. The homogenization treatment can be carried out in one or more stages.

The rolling ingot is then hot rolled, and optionally cold rolled, into a sheet. Advantageously, said sheet is between 0.5 mm and 15 mm thick and preferably between 1 mm and 8 mm thick.

The product so obtained is then solution treated, typically by heat treatment making it possible to reach a temperature ranging between 490° C. and 530° C. for 15 min. to 8 hours, then quenched typically with water at room temperature or preferably with cold water.

Said sheet then undergoes flattening and/or stretching with a cumulated deformation of at least 0.5% and less than 3%. When flattening is carried out, the deformation obtained during the flattening operation is not always known precisely although it is estimated at approximately 0.5%. When it is carried out, controlled stretching is performed with permanent deformation between 0.5% and 2.5% and preferably ranging from 0.5% to 1.5%. The combination between controlled stretching with preferred permanent deformation and a short heat-treatment allows optimal results to be expected in terms of formability and mechanical properties, notably when additional forming and aging are carried out.

The product then undergoes a short heat treatment, already described.

The sheet obtained by a process according to the invention preferably has, between 0 and 50 days and preferably between 0 and 200 days after short heat-treatment, a combination of at least one property chosen among $R_{p0.2}$(L) of at least 220 MPa and preferably of at least 250 MPa, $R_{p0.2}$(LT) of at least 200 MPa and preferably at least 230 MPa, $R_m$(L) of at least 340 MPa and preferably at least 380 MPa, $R_m$(LT) of at least 320 MPa and preferably at least 360 MPa with a property chosen among A % (L) at least 14% and preferably at least 15%, A % (LT) at least 24% and preferably at least 26%, $R_m/R_{p0.2}$ (L) at least 1.40 and preferably at least 1.45, $R_m/R_{p0.2}$ (LT) at least 1.45 and preferably at least 1.50.

In an advantageous embodiment of the invention, after the short heat treatment, a sheet obtained by the method according to the invention has a ratio $R_m/R_{p0.2}$ in the LT direction of at least 1.52 or 1.53.

Advantageously, between 0 and 50 days and most preferably between 0 and 200 clays after the short heat treatment, the sheet obtained by the process according to the invention has a yield strength $R_{p0.2}$ (L) of less than 290 MPa and preferably less than 280 MPa and $R_{p0.2}$ (LT) of less than 270 MPa and preferably less than 260 MPa.

Following short heat-treatment, the sheet is thus ready for additional cold working, notably a 3-dimensional forming operation. An advantage of the invention is that this additional cold working operation may reach values of 6% to 8% or even 10% locally or in a generalized manner. In order to attain sufficient mechanical properties at the completion of an artificial aging to a T8 temper, a minimum cumulated deformation of 2% between said additional deformation and the cumulated deformation by flattening and/or by controlled stretching performed before the short heat-treatment is advantageous. Preferably, the additional cold working is locally or in a generalized manner at least 1%, preferably at least 4% and preferably still at least 6%.

Aging is performed in which said sheet reaches a temperature ranging between 130° C. and 170° C. and preferably between 150° C. and 160° C. for 5 to 100 hours and preferably from 10 to 70 hours. Aging may be performed in one or more stages.

Advantageously, cold working is carried out by one or several forming processes such as drawing, stretch-forming, stamping, spinning or bending. In an advantageous embodiment of the invention, forming takes place in three dimensions to obtain a part of complex shape, preferably by stretch-forming.

The product thus obtained through short heat-treatment can be formed as an O-temper product or a W-temper product. However, compared to an O-temper product, it has the advantage of no longer requiring solution heat-treatment or quenching to attain the final mechanical properties, as simple aging is sufficient. Compared to a W-temper product, it has the advantage of being stable, and does not require a cold room and does not pose problems associated with deformation from this temper. The product also has the advantage of generally not generating unacceptable Lüders lines during forming. The short heat-treatment can thus be performed on the sheet manufacturer's premises and forming can take place on premises of the aeronautic structure manufacturer, directly on the product delivered.

Surprisingly, the balance between the static mechanical properties and the damage tolerance properties obtained following aging is advantageous compared to that obtained by a similar treatment not comprising a short heat-treatment. The inventors noted in particular that the mechanical strength, particularly the tensile yield strength $R_{p0.2}$ (L) is high and increases with the additional deformation but that contrary to their expectations, the toughness measured by the R curve (values of $K_R$) does not decrease significantly, notably for a crack extension value of 60 mm when the additional deformation increases, even up to a generalized deformation of 8%. Advantageously, the product obtainable by the process, comprising the additional deformation and aging steps, has a tensile yield strength $R_{p0.2}$(L) at least essentially equal to a toughness $K_R$ greater, preferably by at least 5%, than that obtained by a similar process not comprising a short heat-treatment. Typically, the tensile yield strength $R_{p0.2}$ (L) is at least equal to 90% or preferably 95% of that obtained by a similar process not comprising a short heat-treatment.

The method according to the invention allows to obtain in particular a AA2198 alloy sheet with a thickness of between 0.5 and 15 mm and preferably between 1 and 8 mm having, after artificial aging to a T8 temper, a combination of at least one static mechanical property selected from $R_{p0.2}$ (L) of at least 500 MPa and preferably of at least 510 MPa and/or $R_{p0.2}$ (LT) of at least 480 MPa and preferably at least 490

MPa, and at least one toughness property measured on CCT760 (2ao=253 mm) test specimens selected from $K_{app}$ in the T-L direction at least 160 MPa$\sqrt{m}$ and preferably of at least 170 MPa$\sqrt{m}$ and/or Keff in the T-L direction at least 200 MPa$\sqrt{m}$ and preferably of at least 220 MPa$\sqrt{m}$ and/or Δaeff(max) in the T-L direction of at least 40 mm and preferably at least 50 mm.

Thus, the products obtainable by the process according to the invention are particularly advantageous.

The use of a product obtainable by the process according to the invention comprising the steps of short heat-treatment, cold working and aging for the manufacture of an aircraft structural element, notably fuselage skin, is particularly advantageous.

EXAMPLE 1

A rolling ingot made of AA2198 alloy was homogenized then hot-rolled to a thickness of 4 mm. The sheets obtained in this manner were solution heat treated for 30 minutes at 505° C., then water quenched.

The sheets were then elongated in a controlled manner. The controlled stretching was carried out with permanent elongation of 2.2%.

The sheets were then subjected to short heat-treatment of 2 hours at 150° C.

The mechanical properties were measured prior to the short heat-treatment and between two and sixty-five days after the treatment. The results are given in Table 1. It is noted that the temper obtained after short heat-treatment is remarkably stable over time.

TABLE 1

| | Rm (L) | $R_{p0.2}$ (L) | A % (L) | Rm (LT) | $R_{p0.2}$ (LT) | A % (LT) |
|---|---|---|---|---|---|---|
| Before short heat-treatment | 438 | 323 | 13 | 404 | 287 | 23 |
| Duration after short heat-treatment (days) | | | | | | |
| 2 | 396 | 270 | 16.8 | 370 | 244 | 27.1 |
| 8 | 396 | 269 | 15.3 | 372 | 247 | 28.0 |
| 15 | 398 | 273 | 14.5 | 374 | 248 | 27.2 |
| 43 | 397 | 270 | 14.9 | 375 | 248 | 27.5 |
| 65 | 398 | 271 | 15.0 | 373 | 250 | 27.2 |
| 104 | 398 | 273 | 14.3 | 373 | 250 | 26.9 |
| 203 | 401 | 277 | 16.1 | 375 | 253 | 26.9 |
| 239 | 402 | 278 | 16.7 | 376 | 255 | 27.7 |

EXAMPLE 2

A rolling ingot made of AA2198 alloy was homogenized then hot-rolled to a thickness of 4 mm. The sheets obtained in this manner were solution heat treated for 30 minutes at 505° C., then water quenched.

The sheets were then flattened and stretched in a controlled manner. The controlled stretching was carried out with permanent elongation of 1%.

The sheets were then subjected to short heat-treatment of 2 hours at 150° C.

The sheets thus obtained then undergo additional cold working by controlled stretching with permanent elongation of 2.5%, 4% or 8%. After deformation, the sheets showed no unacceptable Lüders lines.

The sheets were subjected to an aging treatment at 155° C. for 12 hours to obtain a T8 temper.

For reference a sheet was, directly after quench, stretched 2% and aged 14 h at 155° C. to a T8 temper, without intermediate short heat treatment.

The static mechanical properties were characterized following the aging treatment and are presented in table 2 below: samples #1, #2 and #3 are according to the invention and sample #4 is a reference.

TABLE 2

| Sample | Additional cold work after short heat-treatment | Rm (L) | $R_{p0.2}$ (L) | A % (L) | Rm (LT) | $R_{p0.2}$ (LT) | A % (LT) |
|---|---|---|---|---|---|---|---|
| | Static mechanical properties (MPa) | | | | | | |
| # 1 | 2.5% | 511 | 474 | 11.0 | 499 | 464 | 11.0 |
| # 2 | 4% | 526 | 499 | 10.4 | 513 | 485 | 10.4 |
| # 3 | 8% | 541 | 518 | 9.7 | 516 | 491 | 9.7 |
| # 4 | No short heat treatment | 497 | 454 | 10.2 | 486 | 440 | 12.7 |

The R curves were measured in the T-L direction according to standard E561-05 on the CCT760 test samples, which had a length of 760 mm L. The initial crack length was 2ao=253 mm. The R curves obtained are presented in FIG. 1.

Plane stress fracture toughness results are provided in Table 3. It is noted in particular that even for a further deformation of 8%, the values of $K_{app}$ and $K_{eff}$ are high. Thus the decrease of $K_{app}$ in the T-L direction is low, less than 5%, between 2.5% and 8% stretch.

TABLE 3

| Sample | Additional cold work after short heat-treatment | $K_{app}$ (MPa√m) T-L | $K_{eff}$ (MPa√m) T-L | $\Delta a_{eff\,max}$ (mm) |
|---|---|---|---|---|
| # 1 | 2.5% | 182 | 262 | 79 |
| # 2 | 4% | 177 | 265 | 97 |
| # 3 | 8% | 174 | 238 | 68 |
| # 4 | No short heat treatment | 190 | 274 | 60 |

It is noted that even after additional deformation of 8%, the R-curve remains quite satisfactory: the curve is sufficiently long, in excess of 60 mm, and the values of $K_R$ are near those obtained with lesser deformation (FIG. 1).

EXAMPLE 3

In this example the conditions of time and temperature of the short heat treatment were studied. A rolling ingot made of alloy AA2198 was homogenized and then hot rolled to 4 mm thickness. The sheets obtained in this manner were solution heat treated for 30 minutes at 505° C., then water quenched.

The sheets were then flattened and stretched in a controlled manner. The controlled stretching was carried out with permanent elongation of 1%.

The plates were naturally aged to reach stable T3 temper.

The plates were then subjected to a short heat treatment at 145° C., 150° C. or 155° C. The equivalent time at 150° C. was calculated by taking into account a temperature rise rate of 20° C./h. The static mechanical properties of the sheets were characterized after short heat treatment in the TL direction.

Figure 2:
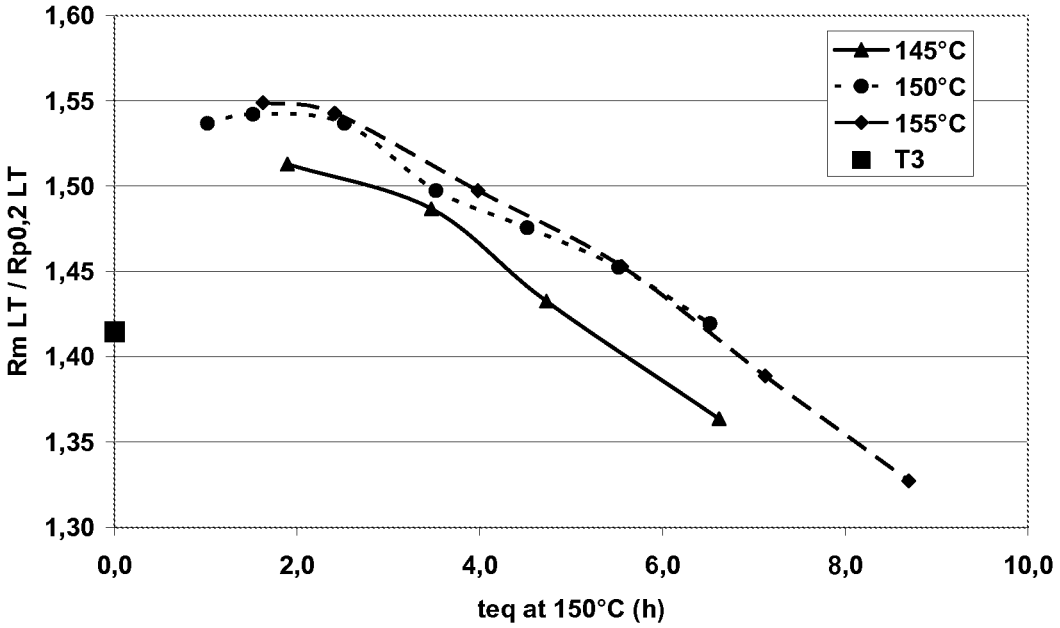
FIG. 2: Ratio of $R_m/R_{P0.2}$, in the LT direction after short heat treatment as a function of equivalent time at 150° C. for short heat treatment temperatures of 145° C., 150' C and 155° C., as described in example 3.

The results are presented in Table 4 below and shown graphically in FIG. 2. It is noted that the highest $R_m/R_{p0.}$2ratio, in the TL direction is obtained for a temperature between 150 and 160° C. and for a time equivalent at 150° C. between one and three hours.

TABLE 4

| Short heat treatment time (h) | Short heat treatment temperature (° C.) | Equivalent time $t_i$ at 150° C. | $Rp_{0.2}$ TL (MPa) | Rm TL (MPa) | A TL (%) | Rm/ $Rp_{0.2}$ (TL) |
|---|---|---|---|---|---|---|
| 0 | 0 | 0 | 288.0 | 407.3 | 22.6 | 1.41 |
| 2.5 | 145 | 1.90 | 245.7 | 371.7 | 29.1 | 1.51 |
| 5 | 145 | 3.47 | 251.3 | 373.7 | 27.6 | 1.49 |
| 7 | 145 | 4.73 | 264.3 | 378.7 | 27.7 | 1.43 |
| 10 | 145 | 6.62 | 283.3 | 386.3 | 25.9 | 1.36 |
| 0.5 | 150 | 1.02 | 240.3 | 369.3 | 25.9 | 1.54 |
| 1 | 150 | 1.52 | 237.3 | 366.0 | 26.1 | 1.54 |
| 2 | 150 | 2.52 | 240.3 | 369.3 | 27.6 | 1.54 |
| 3 | 150 | 3.52 | 246.7 | 369.3 | 28.1 | 1.50 |
| 4 | 150 | 4.52 | 253.0 | 373.3 | 26.3 | 1.48 |
| 5 | 150 | 5.52 | 259.3 | 376.7 | 27.9 | 1.45 |
| 6 | 150 | 6.52 | 264.7 | 375.7 | 26.5 | 1.42 |
| 0.5 | 155 | 1.63 | 235.0 | 364.0 | 28.1 | 1.55 |
| 1 | 155 | 2.41 | 238.3 | 367.7 | 26.4 | 1.54 |
| 2 | 155 | 3.98 | 246.7 | 369.3 | 29.2 | 1.50 |
| 3 | 155 | 5.55 | 262.0 | 380.7 | 24.8 | 1.45 |
| 4 | 155 | 7.12 | 275.3 | 382.3 | 25.5 | 1.39 |
| 5 | 155 | 8.70 | 295.3 | 392.0 | 25.1 | 1.33 |

EXAMPLE 4

In this comparative example, the effect of strain rate on toughness in a process not involving short heat treatment was studied. A rolling ingot alloy AA2198 was homogenized and then hot rolled to 3.2 mm thickness. The sheets obtained in this manner were solution heat treated for 30 minutes at 505° C., then water quenched.

The sheets were then flattened and stretched in a controlled manner. The controlled stretching was carried out with permanent elongation of 3% or 5%.

The plates were then subjected aged 14 h at 155° C. to reach a T8 temper.

Mechanical properties were characterized after aging and are presented in Table 5 below.

TABLE 5

| Sample | Strech | Rm (L) | $R_{p0.2}$ (L) | A % (L) | Rm (LT) | $R_{p0.2}$ (LT) | A % (LT) |
|---|---|---|---|---|---|---|---|
| #5 - 3% | 3% | 525 | 486 | 11.1 | 499 | 459 | 14.1 |
| #6 - 5% | 5% | 545 | 519 | 10.4 | 518 | 487 | 14.0 |

R-curves were measured according to standard E561-05 test on CCT760 test samples, which had a width of 760 mm, in the direction of T-L and L-T directions. The initial crack length was 2ao=253 mm.

Toughness results obtained are presented in Table 6. It is noted in particular that the decrease in $K_{app}$ in the T-L direction is significant, about 9%, between 3% and 5% stretch.

TABLE 6

| | | T-L | | | L-T | | |
|---|---|---|---|---|---|---|---|
| Sample | Thickness [mm] | $K_{app}$ (MPa√m) | $K_{eff}$ (MPa√m) | $\Delta a_{eff\ max}$ (mm) | $K_{app}$ (MPa√m) | $K_{eff}$ (MPa√m) | $\Delta a_{eff\ max}$ (mm) |
| #5 - 3% | 3.2 mm | 151 | 178 | 61 | 124 | 152 | 115 |
| #6 - 5% | 3.2 mm | 138 | 174 | 67 | 119 | 142 | 55 |

The invention claimed is:

1. A 3-dimensional formed fuselage skin sheet for the aeronautic industry manufactured by a process comprising:

a) preparing a molten metal bath comprising aluminum, said molten bath comprising from 3.0% to 3.5% Cu by weight, from 0.8% to 1.1% Li by weight, from 0.25% to 0.6% Mg by weight, from 0.10% to 0.50% Ag by weight, from 0% to 0.35% Zn by weight, at most 0.18% Fe+ Si by weight, 0.04% to 0.18% Zr by weight, other elements≤0.05% by weight each and ≤0.15% by weight in total, remainder aluminum;

b) casting a rolling ingot from said molten metal bath;

c) optionally, homogenizing said rolling ingot;

d) hot rolling the optionally homogenized rolling ingot, and optionally cold rolling, into a sheet having a thickness of from 1 mm to 8 mm;

e) solution heat treating and quenching said sheet;

f) flattening and/or stretching the solution heat treated and quenched sheet with a cumulated deformation of at least 0.5% and not more than 3%;

g) performing short heat-treatment, wherein said short heat-treatment is carried out to obtain an equivalent time at 150° C. from 0.5 hour to 5 hours, wherein equivalent time $t_i$ at 150° C. is defined by formula:

$$t_i = \frac{\int \exp(-16400/T)dt}{\exp(-16400/T_{ref})}$$

where T (in Kelvin) is instantaneous treatment temperature of the flattened and/or stretched sheet, which changes with time t (in hours), $T_{ref}$ is reference temperature set at 423 K, and $t_i$ is expressed in hours;

h) performing 3-dimensional forming operation with additional cold working of at least 4% and not more than 8% of the short heat-treated sheet to obtain the fuselage skin sheet; and i) performing an artificial aging in which said 3-dimensional formed fuselage skin sheet reaches a temperature ranging between 130° C. and 170° C. for 5 to 100 hours;

wherein the 3-dimensional formed fuselage skin sheet is a 3-dimensional rolled product;

wherein the 3-dimensional formed fuselage skin sheet comprises a combination of:

at least one property selected from the group consisting of: (i) $R_{p0.2}$ (L) of at least 500 MPa and (ii) $R_{p0.2}$ (LT) of at least 480 MPa, and at least one property measured on CCT760 (2ao=253 mm) test specimens selected from the group consisting of (1) $K_{app}$ in the T-L direction at least 160 MPa√m and (2) $K_{eff}$ in the T-L direction at least 200 MPa√m.

2. The 3-dimensional formed fuselage skin sheet according to claim 1, wherein said short heat-treatment is carried out to obtain an equivalent time at 150° C. from 1 hour to 4 hours.

3. The 3-dimensional formed fuselage skin sheet according to claim 1, wherein said short heat-treatment is carried out to obtain an equivalent time at 150° C. from 0.5 hour to 4 hours.

4. The 3-dimensional formed fuselage skin sheet according to claim 1, wherein said product comprises a combination of:

at least one property selected from the group consisting of: (i) $R_{p0.2}$ (L) of at least 510 MPa and (ii) $R_{p0.2}$ (LT) of at least 490 MPa, and at least one property measured on CCT760 (2ao=253 mm) test specimens selected from the group consisting of (1) $K_{app}$ in the T-L direction at least 170 MPa$\sqrt{m}$ and (2) $K_{eff}$ in the T-L direction at least 220 MPa$\sqrt{m}$.

5. A 3-dimensional formed fuselage skin sheet for the aeronautic industry manufactured by a process comprising:

a) preparing a molten metal bath comprising aluminum, said molten bath comprising from 3.0% to 3.5% Cu by weight, from 0.8% to 1.1% Li by weight, from 0.25% to 0.6% Mg by weight, from 0.10% to 0.50% Ag by weight, from 0% to 0.35% Zn by weight, at most 0.18% Fe+ Si by weight, 0.04% to 0.18% Zr by weight, other elements≤0.05% by weight each and ≤0.15% by weight in total, remainder aluminum;

b) casting a rolling ingot from said molten metal bath;

c) optionally, homogenizing said rolling ingot;

d) hot rolling the optionally homogenized rolling ingot, and optionally cold rolling, into a sheet having a thickness of from 1 mm to 8 mm;

e) solution heat treating and quenching said sheet;

f) flattening and/or stretching the solution heat treated and quenched sheet with a cumulated deformation of at least 0.5% and not more than 3%;

g) performing short heat-treatment in which the flattened and/or stretched sheet reaches a temperature ranging from 130° C. to 170° C. for from 0.1 to 5 hours;

h) performing 3-dimensional operation with additional cold working of at least 4% and not more than 8% of the short heat-treated sheet to obtain the fuselage skin sheet; and i) performing an artificial aging in which said 3-dimensional formed fuselage skin sheet reaches a temperature ranging between 130° C. and 170° C. for 5 to 100 hours;

wherein the 3-dimensional formed fuselage skin sheet is a 3-dimensional rolled product;

wherein the 3-dimensional formed fuselage skin sheet comprises a combination of:

at least one property selected from the group consisting of: (i) $R_{p0.2}$ (L) of at least 500 MPa and (ii) $R_{p0.2}$ (LT) of at least 480 MPa, and at least one property measured on CCT760 (2ao=253 mm) test specimens selected from the group consisting of (1) $K_{app}$ in the T-L direction at least 160 MPa$\sqrt{m}$ and (2) $K_{eff}$ in the T-L direction at least 200 MPa$\sqrt{m}$.

6. The 3-dimensional formed fuselage skin sheet according to claim 5, wherein, at f, controlled stretching is performed with permanent deformation from 0.5% to 1.5%.

7. The 3-dimensional formed fuselage skin sheet according to claim 5, wherein lithium is present in an amount of at least 0.85% by weight and at most 1.1% by weight.

8. The 3-dimensional formed fuselage skin sheet according to claim 5, wherein zinc is present in an amount greater than 0% to 0.35% by weight.

9. The 3-dimensional formed fuselage skin sheet according to claim 5, wherein the alloy comprises from 0.08% to 0.15% of zirconium by weight.

10. The 3-dimensional formed fuselage skin sheet according to claim 5, wherein g) comprises performing short heat-treatment in which said sheet reaches a temperature ranging from 130° C. to 170° C. for from 1 to 5 hours.

11. The 3-dimensional formed fuselage skin sheet according to claim 5, wherein g) comprises performing short heat-treatment in which said sheet reaches a temperature ranging from 150° C. to 160° C.

12. The 3-dimensional formed fuselage skin sheet according to claim 5, wherein silver is present in an amount from 0.15% to 0.4% by weight.

13. The 3-dimensional formed fuselage skin sheet according to claim 12, wherein zinc is present in an amount greater than 0% and less than 0.2% by weight.

14. The 3-dimensional formed fuselage skin sheet according to claim 5, wherein said product comprises a combination of:

at least one property selected from the group consisting of: (i) $R_{p0.2}$ (L) of at least 510 MPa and (ii) $R_{p0.2}$ (LT) of at least 490 MPa, and at least one property measured on CCT760 (2ao=253 mm) test specimens selected from the group consisting of (1) $K_{app}$ in the T-L direction at least 170 MPa$\sqrt{m}$ and (2) $K_{eff}$ in the T-L direction at least 220 MPa$\sqrt{m}$.

* * * * *